United States Patent [19]

Wilson, Jr.

[11] 4,079,363

[45] Mar. 14, 1978

[54] DOUBLE-DETECTING LOOP TYPE ALARM SYSTEM

[75] Inventor: Stanley Wilson, Jr., Charles, Mo.

[73] Assignee: Potter Electric Signal Co., St. Louis, Mo.

[21] Appl. No.: 722,408

[22] Filed: Sep. 13, 1976

[51] Int. Cl.[2] ..... G08B 19/00

[52] U.S. Cl. ..... 340/276; 340/213 R; 340/409

[58] Field of Search ..... 340/276, 409, 420, 213 R, 340/213.1, 412

[56] References Cited

U.S. PATENT DOCUMENTS 4,030,095 6/1977 Dalman ..... 340/276

*Primary Examiner*—John W. Caldwell, Sr.

*Assistant Examiner*—Donnie L. Crosland

[57] ABSTRACT

Each zone of a double-detecting loop type alarm system utilizes a current level detector to produce a digital signal when normal current flow in the detecting loops is interrupted. The digital signal so produced is stored in a holding register, whose output drives electronic shunting switches connected across the ends of the detecting loops. Closing of the switches permits current to again flow to the current level detector and detecting loops, causing the current to return to a normal current level if the interruption was caused by a break or short in a detecting loop; this permits that zone of the alarm system to again function. Since the system is digital, its ouputs and those of the other zones are presented by means of other digital transmitting and monitoring devices, such as a binary multiplexer.

5 Claims, 1 Drawing Figure

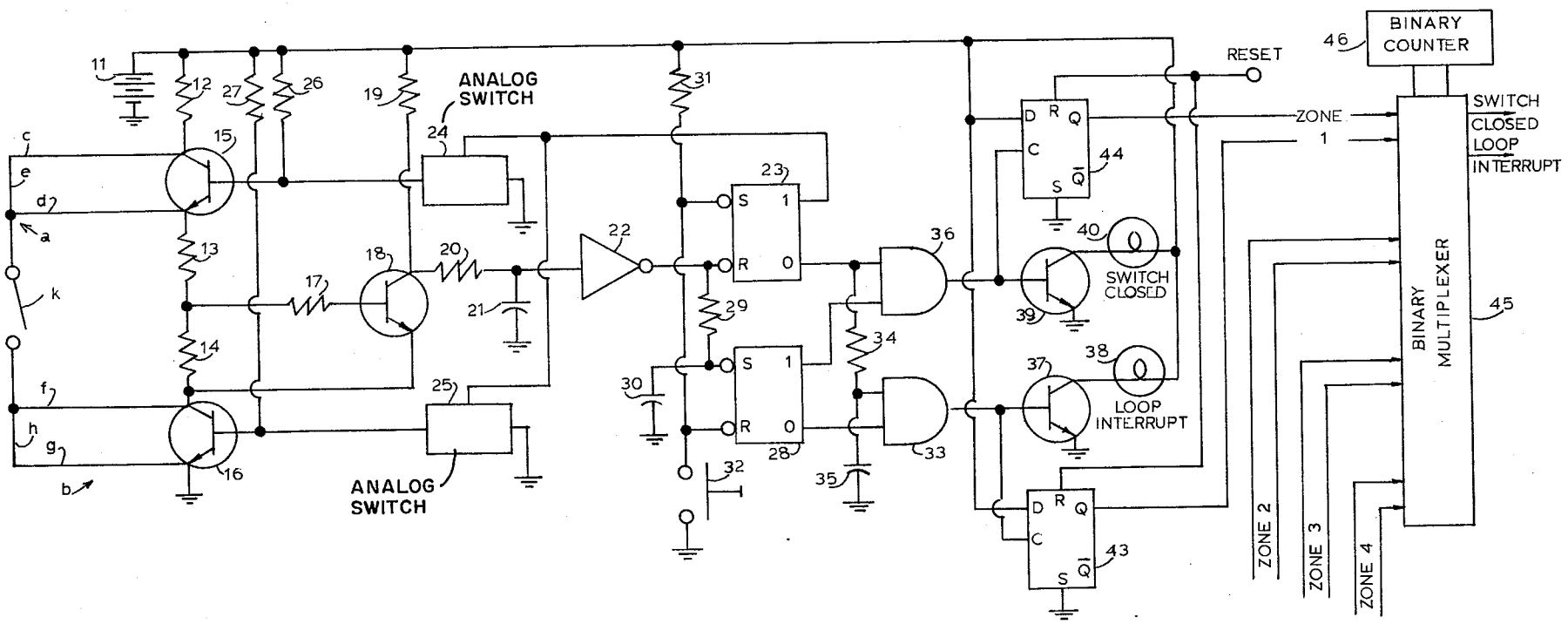
BINARY COUNTER
46
SWITCH CLOSED
LOOP INTERRUPT
BINARY MULTIPLEXER
45
ZONE 1
ZONE 2
ZONE 3
ZONE 4
RESET
SWITCH CLOSED
LOOP INTERRUPT
ANALOG SWITCH
ANALOG SWITCH

DOUBLE-DETECTING LOOP TYPE ALARM SYSTEM

BACKGROUND OF THE INVENTION

Alarm systems such as conventionally used for fire detection and capable of use for intrusion detection may have double detecting loops for greater immunity from failure. In the prior art such alarm systems were provided with means to shunt said loops should they break or short so that the alarm system could continue to function. In earlier devices the shunting was performed by manual switching by operators after an indication of a break or short. More complex circuity utilized a motor driven rotary switch to reset the system so that it might continue to function and to signal an alarm condition should one occur. Rotating the switch to reset for continued functioning involved a time delay of typically 15 seconds, and rotating the switch to signal an alarm took 45 more seconds, due to low gearing of the motor for the accuracy required. Such a lengthy time delay is too long for adequate fire protection and would permit intruders sufficient time to thwart the system.

SUMMARY OF THE INVENTION

A principal purpose of the present invention is to greatly decrease the time required to reset a zone of a double-detecting loop alarm system so that it may continue to function after a break or short in one of the detecting loops. Further purposes include adapting the system for use with solid state digital circuity to insure greater efficiency and reliability, and to permit multiplexing of information from multiple zones.

Generally summarizing, each zone of the present invention utilizes two conventional detecting loops to meet approved specifications for alarm systems of this general type. The detecting loops form a series circuit from a constant voltage source and have a resistor in series between them. A normally open protective switch is connected between the two detecting loops, to divert part of the current from the resistor and thus prevent it from reaching a normal current level when the switch is closed. A current level detector, preferably a transistor, produces a digital signal state when the current level in the resistor drops below the normal current level. A holding register stores the digital signal state and causes shunting switches, which may also be transistors, to shunt the detecting loops. Thus, if a break or short occurs in a detecting loop, that zone of the alarm system may continue to function.

A second holding register having a time delayed input from the current level detector indicates when the normal current level is not regained by the shunting of the detecting loops. One logic gate, responsive to both holding registers, produces a "switch closed" signal when the normal current level is so regained. Another logic gate, also responsive to both holding registers, through the use of a second time delay, produces a "loop interruption" signal when the normal current level is regained by shunting the loops. Annunciators, coupled to each logic gate, indicate when such signals are produced.

Since the system is digital, it may be combined with a variety of transmitting and monitoring devices. One such combination includes a binary multiplexer and a freerunning binary counter to multiplex inputs from the several zones.

BRIEF DESCRIPTION OF THE DRAWING

The drawing is a circuit diagram illustrating the preferred embodiment of the present invention.

DESCRIPTION OF THE PREFERRED EMBODIMENT

A preferred embodiment of the present multiple-zone alarm system is shown in the accompanying drawing.

For each alarm system zone, two conventional detecting loops *a, b* extend from the detecting apparatus to be described to carry supervisory current to a location in protected premises requiring supervision. The first detecting loop, generally designated *a,* has a first leg *c* and a second leg *d* connected at a closed end *e.* The similar second detecting loop, generally designated *b,* is comprised of a first leg *f* and a second leg *g* connected at a closed end *h.*

Coupled between the two closed ends *e, h* of the two detecting loops *a, b* is a conventional normally open protective switch *k* which closes when a condition to be signalled occurs. The switch *k* might be of the type which closes upon sensing heat, as in a fire alarm system, or upon sensing an intrusion, as in a burglar alarm system.

As an alternative, in an intrusion system a normally closed protective switch device might be provided across the end of each loop to form the closed ends *e, h.* Opening of the switch would indicate an intrusion.

The following elements form a series supervisory circuit. A 12 V power source 11 is connected to a current limiting resistor 12 which is connected to the open end of the first leg *c* of the first detecting loop *a.* A second current limiting resistor 13 is connected from the open end of the second leg *d* to one lead of a detector resistor 14, its other lead being connected to the open end of the first leg *f* of the second detecting loop *b.* The open end of the second leg *g* of the second loop *b* is connected to ground potential, completing the circuit.

A first transistor 15, of the npn type, has its collector terminal connected to the first leg *c* and its emitter to the second leg *d* of the first detecting loop *a.* Likewise, a similar second transistor 16 has its collector connected to the first leg *f* and its emitter connected to the second leg *g* of the second detecting loop *b.* Through a base resistor 17, a third transistor 18 has its base coupled between the second current limiting resistor 13 and the detector resistor 14. Its emitter is connected to the collector of the second transistor 16, while its collector is coupled through a first pull-up resistor 19 to the 12 V power source 11. Also from its collector a high value resistor 20 is coupled to one lead of a first capacitor 21, whose other lead is connected to ground potential.

That lead of the resistor 20 connected to the capacitor 21 also is connected to the input of an inverter gate 22. The output of the inverter gate 22 is connected to the "R" input of a first set-reset flip-flop 23, familiar to those skilled in the art. The "1" output of the first flip-flop 23 drives the gates of a first analog switch 24 and a second analog switch 25. One line terminal of the first analog switch 24 is connected to ground potential while the other is connected to the base of the first transistor 15 and to a second pull-up resistor 26 coupled to the 12 V power source 11. Likewise, one line terminal of the second analog switch 25 is connected to ground potential while the other is connected to the base of the second transistor 16 and to a third pull-up resistor 27 coupled to the 12 V power source 11.

The "S" input of a second set-reset flip-flop 28 is coupled to the output of the inverter gate 22 through a discharge resistor 29. A second capacitor 30 is coupled to ground from that "S" input. The "R" input of the second set-reset flip-flop 28 and the "S" input of the first set-reset flip-flop 23 are each coupled through a fourth pull-up resistor 31 to the 12 V power source 11 and to ground potential through a normally open reset switch 32. As shown by the drawing, the inputs of two flip-flops 23, 28, are connected in opposite senses; that is, the inverter gate 22 leads to the "R" input of the first flip-flop 23 and the "S" input of the second flip-flop 28, whereas the "S" input of the first flip-flop 23 and the "R" input of the second flip-flop 28 are connected to the reset switch 32.

A first two-input AND gate 33 has one input connected to the "0" output of the second set-reset flip-flop 28 and the other input coupled through a second discharge resistor 34 to the "0" output of the first set-reset flip-flop 23. A third capacitor 35 connects that input to ground potential. A second two-input AND gate 36 has one input connected to the "0" output of the first set-reset flip-flop 23 and its remaining input connected to the "1" output of the second set-reset flip-flop 28.

A first lamp driver transistor 37 is coupled to the output of the first AND gate 33 to switch a first 12 V lamp 38 powered by the 12 V power source 11. Likewise, a second lamp driver transistor 39 is coupled to the output of the second AND gate 36 to switch a second 12 V lamp 40 powered by the 12 V power source 11.

A first D-type flip-flop 43 having a reset input has its "C" (clock) input connected to the output of the first AND gate 33. A similar second D-type flip-flop 44 has its "C" input connected to the output of the second AND gate 36. The "D" inputs of both D-type flip-flops 43, 44 are connected to the 12 V power source 11. Automatic reset means, coupled to the "R" (reset) inputs of both these flip-flops 43, 44 may be provided. The "S" inputs are tied to ground.

The "Q" outputs of both D-type flip-flops 43, 44 are inputted to the zone 1 inputs of a binary multiplexer 45, while similar "Q" outputs from other alarm system zones are inputted to the zone 2, 3, and 4 inputs of the binary multiplexer 45. A free-running binary counter 46 is also coupled to the multiplexer 45. This multiplexer, which may be an integrated circuit device, has a loop interrupt output and a switch closed output.

In normal operation of the multiple zone alarm system, a normal current level flows from the 12 V power source 11 through the first current limiting resistor 12, the first detecting loop *a*, second current limiting resistor 13, detector resistor 14, and second detecting loop *b* to ground. This normal current level causes the third transistor 18 to conduct, making its digital output "low." the inverter gate 22 reverses this to a "high." The first and second flip-flops 23, 28 are of the type for which a "high" at both the "S" and "R" inputs causes no change from the preceding state. Since the inputs to the flip-flops 23, 28 are held "high", the "1" output of the first flip-flop 23 becomes "low" after the "R" input receives a "low". By momentarily pulling its "S" input low the reset switch 32 is used to reset the first flip-flop 23 with its "1" output "high" and its "0" output "low", as is the case upon start-up. The "high" "1" output of the first flip-flop 23 causes the analog switches 24, 25 to be closed, allowing current to flow, thus keeping the first and second transistors nonconducting by pulling their bases to ground potential.

A loop interruption signal will be generated if either or both of the detecting loops should break, or if the first detecting loop *c* should shunt to ground potential or simultaneously break and short to ground, or if the second detecting loop *b* should break while the first detecting loop *a* shorts to ground, or if a normally closed protective switch across the ends of *c* loop should open. In any of these events, the current flow through the detector resistor 14 will be substantially zero, causing the third transistor 18 to cease conduction. The first pull-up resistor 19 pulls this transistor's collector "high." Since the output of the inverter then goes "low," the 1 output of the first flip-flop 23 is latched "low," referred to as a latched signal, opening the analog switches 24, 25. The second and third pull-up resistors 26, 27 pull the bases of the first and second transistors "high," causing the transistors 15, 16 to conduct. Current then again flows through the detector resistor 14, causing the third transistor 18 to again conduct, forcing its collector "low," and the output of the inverter 22 "high." This has no effect upon the first flip-flop 23; it remains latched.

As for the second flip-flop 28, when the output of the inverter 22 first became "low," the second capacitor 30 began to discharge through the first discharge resistor 29. The resistor 29 and capacitor 30 are so chosen as to provide a time delay of a sufficient duration such that when the first flip-fiop 23 is latched, thereby causing normal current flow through the series supervisory circuit, the time delay associated with this resumption of normal current flow and the subsequent signalling of such resumption is shorter than the time delay provided by the resistor-capacitor. Typically, this time delay might be on the order of a millisecond. Thus, the second flip-flop 28 does not change state, the "1" output remains "low" and the "0" output remains "high," as after reset upon start-up. At this point, the "0" outputs of the first flip-flop 23 and the second flip-flop are both "high," causing the first AND gate 33 to produce a "high" output signal, which has been referred to as a loop interruption signal. The output of the second AND gate is "low."

If the normally open protective switch *k* should be closed as due to sensing of a fire or an intruder normal current flow through the detector resistor 14 will be interrupted. In the instance when the switch is closed when there has been no prior loop break or short, no current flows through the detector resistor 14 and the third transistor 18 does not conduct, causing its output to be "high". The "low" output from the inverter causes the first flip-flop 23 to latch, causing the first and second transistors 15, 16 to conduct. Current flows through both the detecting loop and detector resistor paths. The values of the various resistors are chosen to so relate to the resistance of the detecting loops that the current through the detector resistor 14 is now not great enough to cause the third transistor 18 to conduct. Its output remains "high." Thus the output of the inverter 22 remains "low" long enough to overcome the time delay of the combination of the discharge resistor 29 and the second capacitor 30, causing the second flip-flop 28 to latch "high," referred to as a latched signal.

At this point both "0" output of the first flip-flop 23 and the "1" output of the second flip-flop 28 are "high," and the second AND gate 36 produces a "high" output signal, also referred to as a switch closed signal. The combination of the second discharge resistor 34 and the third capacitor 35 produces a time delay to the first AND gate 33. This time delay is longer than the time delay to the second flip-flop 28; it affords sufficient time for the second flip-flop 28 to latch, so that if it becomes latched no loop interruption signal is produced.

If the normally open protective switch should be closed after a prior break or short in the detecting loops *a, b,* so that the first and second transistors 15, 16 are already shunting the loops *a, b,* again the current flow through the detector resistor 14 will fall low enough that the third transistor will no longer conduct. Its "high" collector will drive the output of the inverter low. After the passage of the time delay caused by the first discharge resistor 29 and second capacitor 30, the second flip-flop 28 is latched. This causes the loop interruption signal to cease and the switch closed signal to be produced. These conditions are indicated by the lamps 38, 40.

Should a break or short occur in the detecting loops *a, b* at a time when the protective switch *k* is already closed, there will be no change. The switch closed signal will continue and no loop interruption signal will be produced.

The D-type flip-flops 43, 44 are reset by a "high" to their "R" inputs. Since their "D" inputs are held "high," a "high" on their "C" (clock) inputs will latch a "high" at their "Q" output. Therefore, when the first AND gate 33, produces a loop interruption signal the first D-type flip-flop 43 stores the signal. The second D-type flip-flop 44 latches in response to a switch closed signal from the second AND gate 36.

These latched "high" outputs, and similar latched outputs from the other three zones of the multiple-zone alarm system are received by a binary multiplexer 45. The binary counter 46 which counts from zero to three repetitively, corresponding to zones 1–4, causes the multiplexer 45 to indicate the outputs of each single zone in ordered progression. This output might be utilized for efficient transmission to another location or for more efficient monitoring by an operator at this location.

An exceptional advantage of the present invention over the prior art lies in the speed with which it generates its signals. The 15 to 60 second time delays inherent in a motor-driven switch system are unsatisfactory. The present invention operates without any apparent time delay.

By utilizing digital circuity to accomplish this increase in speed it becomes possible to use a double-detecting loop system, originally designed for fire protection, with other types of switches, such as intrusion switches. Further, it may include a variety of apparatus for processing its digital signals, such as the multiplexer described above.

Other types of normally open switchable shunting devices might be substituted for the first and second transistors 15, 16. Also, another type of holding register might be substituted for the flip-flops. If desired to reset the lamps automatically and the output to the multiplexer 45 manually, the annunciater could be driven by the resettable flip-flops 43, 44 while the multiplexer was driven by the AND gates 33, 36.

Other modifications and substitutions will from this specification be apparent to persons skilled in the art.

I claim:

1. An alarm system of the double-detecting loop type, comprising two detecting loops, normally open switchable shunting means associated with each said detecting loop for shunting both upon the closing of said shunting means, constant voltage source means to provide current for said detecting loops, resistor means, operably connected to said detecting loops, for conducting the current provided by said voltage source means, current level detection means for producing a digital signal state when such current through said resistor means drops below a normal current level, said detecting loops having connectors to which a normally open protective switch may be connected, whereby to short said detecting loops when such protective switch is closed, thereby to prevent such current from reaching such normal current level, first digital holding register means to store the digital signal state so produced as a latched signal and to cause said switchable shunting means to close, whereby when normal current level flow is interrupted, said detecting loops are so shunted as to permit current flow through said resistor means, and to hold such latched signal even if such current flow thereafter reaches such normal current level and thereby discontinues such digital signal state, second digital holding register means to store the digital signal state so provided as a latched signal, time delay means, linking said second holding register means to said current level detection means, to prevent such storing in said second holding register means for a time duration sufficient to permit such discontinuance of such digital signal state should such normal current level be regained, reset means for clearing said first and second holding register means, and means to interpret such latched signals.

2. An alarm system of the double-detecting loop type as defined in claim 1, wherein said means to interpret said latched signals includes gating means, responsive to said first and second holding register means, to produce a loop interruption signal when only said first holding register means has a latched signal, and gating means, responsive to said first and second holding register means, to produce a switch closed signal when both said first holding register means and said second holding register means have latched signals.

3. An alarm system as defined in claim 2, together with annunciating means responsive to such loop interruption signal from said gating means, and annunciating means responsive to such switch closed signal from said gating means.

4. As a multiple-zone alarm system, a plurality of alarm systems each as defined in claim 2, each further having first resettable holding register means for storing such loop interruption signal from said gating means, second resettable holding register means for storing such switch closed signal from said gating means, and a second time delay means, interposed to delay such loop interruption signal to said first resettable holding register means, whereby when such switch closed signal is produced, such loop interruption signal is not produced, said multiple-zone alarm system further having binary counter means, binary multiplexing means having a loop interruption output and a switch closed output, said multiplexing means being so responsive to such signals of said gating means of each of said plurality of alarm systems and to said binary counter means as to indicate at its said loop interruption output and its said switch closed output an ordered presentation of the inputs from each of said plurality of alarm systems.

5. An alarm system of the double-detecting loop type, comprising two detecting loops, a first transistor whose emitter-collector circuit shunts one said detecting loop when said transistor is conducting, a similar second transistor whose emitter collector shunts the other said detecting loop when said second transistor is conducting, constant voltage source means to provide current for said detecting loops, a detector resistor connecting said two detecting loops in series combination, a third transistor responsive to the current through said detector resistor, said transistor being rendered nonconductive in the event that such current is less than a normal current level, said detecting loops having connectors to which a normally protective switch may be connected, whereby to short said detecting loops when such protective switch is closed, thereby to prevent such current from reaching such normal current level, a first flip-flop responsive to the nonconduction of said third transistor, whereby on said event said first flip-flop stores a latched signal, said first and second transistors being so connected as to receive such latched signal and to be thereby rendered again conductive, whereby to restore the flow of current through said detector resistor, a second similar flip-flop having an associated resistor-capacitor combination so interposed between said third transistor and said second flip-flop as to produce a time delay, whereby to prevent such storing of such latched signal in said second flip-flop for a time duration sufficient to permit said third transistor to be rendered conductive should such normal current level be regained, reset means for clearing said first and second flip-flops, a first AND gate responsive with an output signal to the combination of a latched signal from said first flip-flop and the absence of a latched signal from said second flip-flop, and a similar second AND gate responsive with an output signal to the combination of a latched signal from both said first flip-flop and said second flip-flop.

* * * * *